US005082136A

United States Patent [19]

Schumann

[11] Patent Number: 5,082,136

[45] Date of Patent: Jan. 21, 1992

[54] CONTAINER AND CAP CONSTRUCTION

[75] Inventor: Ronald C. Schumann, West Chicago, Ill.

[73] Assignee: Enviro-Packaging Corp., St. Charles, Ill.

[21] Appl. No.: 651,307

[22] Filed: Feb. 6, 1991

[51] Int. Cl.[5] ..... B65D 17/44; B65D 51/22

[52] U.S. Cl. ..... 220/278; 220/277; 220/258; 220/359; 220/212; 215/257; 215/228

[58] Field of Search ..... 220/278, 258, 277, 359, 220/214, 212; 215/250, 252, 257, 232, 228

[56] References Cited

U.S. PATENT DOCUMENTS

| | | | |
|---|---|---|---|
| 3,402,855 | 9/1968 | Schroeder et al. | 222/83 |
| 4,634,013 | 1/1987 | Bar-Kokhba | 215/257 X |
| 4,709,822 | 12/1987 | Vataru | 215/257 X |
| 4,754,889 | 7/1988 | Debetencourt | 215/232 |
| 4,934,545 | 6/1990 | Pezzoli et al. | 215/308 X |

*Primary Examiner*—Stephen Marcus

*Assistant Examiner*—Paul A. Schwarz

*Attorney, Agent, or Firm*—Wood, Phillips, Mason, Recktenwald & Van Santen

[57] ABSTRACT

Difficulties in removing a film-like seal (14) from the access opening (12) of a container (10) may be avoided in a container and cap construction including a container (10) whose access opening (12) has an edge (20) of circular shape and of a particular inside diameter, a cap (16) for the opening (12), snap-fit components (28, 30) or threads (140, 142) for removably holding the cap (16) on the container (10) to occlude the access opening (12), a membrane or foil-like seal (14) bonded to the container (10) about the access opening (12) to be free of the cap (16) and at least one cutting tooth (50, 104) carried by the cap (16) and displaced from a rotation point (54) on the cap (16) about which the cap (16) may be rotated relative to the access opening (12) a distance equal to or slightly more than one-half of the particular diameter.

19 Claims, 2 Drawing Sheets

CONTAINER AND CAP CONSTRUCTION

FIELD OF THE INVENTION

This invention relates to a container and cap construction, and more particularly, to a construction wherein a container is sealed by a membrane and/or foil-like seal and wherein means are provided for cutting the seal to allow access to the contents of the container.

BACKGROUND OF THE INVENTION

In the packaging of material whose quality is subject to deterioration upon exposure to the ambient, it has long been popular to employ a relatively rigid container having an access opening which is sealed by a membrane and/or foil-like seal. Not only do seals of this sort prevent exposure of the contents to the ambient, they also provide a good indication, even upon only cursory inspection, as to whether the contents of the container have been tampered with. This, of course, is frequently an important consideration where the contents of the container are food stuffs or pharmacuticals.

The seals, however, are not without one substantial drawback. Frequently, they are difficult to remove completely. Thus, if the contents of the container are in liquid form, the residual part of the seals that remains on the container about the access opening frequently will interfere with clean pouring of the contents. In other cases, complete removal of the seal in order to achieve maximum access to the contents, whether the contents are liquid or solid, requires multiple efforts at removing the seal before the entirety of the seal is removed.

Early attempts to solve this difficulty typically included the provision of a tab that extended beyond the periphery of the access opening to which the seal was bonded. In theory, grasping of the tab would allow the seal to be peeled back from the opening in a single piece to entirely open the access opening More often than not, however, the tab would tear off of the seal or the seal itself would tear such that only part of the same was removed upon pulling of the tab.

Another attempt to minimize the seal removing difficulty is represented by the disclosure of U.S. Pat. No. 3,402,855 issued Sep. 24, 1968 to Schroeder, et al. Schroeder, et al. discloses a container that is typically closed by such a seal and wherein the seal is in turn protected by a conventional cap or cover for the container. When it is desired to achieve access to the contents of the container, the conventional cover is discarded and a dispensing cover having an open spout is placed on the vessel and rotated thereon such that cutters on the dispensing spout pierce and cut or tear the seal to open the container.

This approach, however, is not satisfactory for a number of reasons. Firstly, the cut seal remains within the container and, if food stuffs are employed therein, may become embedded in the same and ultimately enter the mouth of a consumer along with the food stuff, obviously an undesirable occurrence. Secondly, if the contents of the container are in liquid form, the fact that the severed seal remains within the container may result in the same wholly or partially occluding the access opening to prevent free release in pouring of the liquid therefrom.

Secondly, two component parts, a conventional cover and a special dispensing cover including the cutters are required, making the construction inordinately costly. Numerous other disadvantages will be readily apparent to those knowledgeable in the art.

To avoid these and other problems, Debetencourt in U.S. Pat. No. 4,754,889, issued July 5, 1988, has proposed another approach. According to Debetencourt, a single, non-conventional cover is employed and includes teeth on its interior along with a depressed central interior section that extends towards the container a greater distance than the teeth. A membrane or foil-like seal that is intended to close the container is bonded to the depressed center of the cap. The seal may be severed simply by pushing the cap toward the access opening to stretch the seal such that it comes in contact with the cutting edge on the cap and is ultimately severed. Because the seal is bonded to the center of the cap, once the cap is removed from the container, the seal remains with it and cannot remain within the container to become embedded with the contents thereof or hinder the dispensing of the contents through the access opening.

This approach, while an improvement, is also not without fault. For one, the nature of the opening process is such that there is no assurance that the seal will be severed about its entire periphery which is to say one or more strands of the seal may remain, attaching the center of the seal to the periphery which remains bonded to the container. The strands, while easily broken when the cover is removed, can be an impediment to easy pouring of liquid contents from the container. They also may prevent the establishment of a good seal between the cap and the container if the cap is used to reclose the container when part of the contents remain therein.

Even more importantly, because the seal is bonded to the cover, it is impossible to inspect the seal upon removal of the cover to see if the seal has been violated because the act of removing the cover to expose the seal itself breaks the seal.

The present invention is directed to overcoming one or more of the above problems.

SUMMARY OF THE INVENTION

It is the principal object of the invention to provide a new and improved container and cap construction. More particularly, it is an object of the invention to provide such a container and cap construction of the sort utilizing a membrane and/or foil-like seal to cover the access opening of a container so that the same may be easily opened without part or all of the seal remaining as an undesirable remnant that may interfere with the access to, or the dispensing of the contents of the container.

An exemplary embodiment of the invention achieves the foregoing object in a container and cap which includes a container having an access opening with an edge of circular shape of a particular inside diameter. A cap is provided for the opening and means are located on the cap and on the container for removably holding the cap on the container to occlude the access opening. A membrane or foil-like seal is bonded to the container about the access opening so as to be free of the cap. At least one cutting tooth is carried by the cap and is displaced from a rotation point on the cap about which the cap may be rotated relative to the access opening a distance equal to or slightly more than one half of the particular diameter and has at least two converging sharp edges and at least one piercing point between the sharp edges so that the point may pierce the seal and rotation of the cap relative to the access opening may cause at least one of the sharp edges to cooperate with the access opening edge to provide a scissors-like cutting action on the seal.

In a preferred embodiment of the invention, the tooth is shaped as a triangle whose base is at least twice its height.

Preferably, the triangle is an isosceles triangle

According to the invention, the cap has a concave side for receiving the container about the access opening and the tooth is on the concave side of the cap.

In a highly preferred embodiment, the tooth is bendable and at least one of the tooth and the access opening edge includes means responsive to insertion of the tooth into the access opening for bending the tooth behind the seal for capturing the seal against the cap.

In one embodiment, the radially outer side of the tooth is displaced from the rotation point a distance just greater than half the particular diameter so that the resulting interference between the access opening edge and the radially outer side will bend the tooth to define the capturing means.

According to an alternative embodiment, the capturing means includes the cam surface adjacent the access opening edge engageable by the tooth. The cam surface acts to deflect the piercing point radially inwardly and behind the seal to capture the seal.

In a highly preferred embodiment, there are at least two angularly spaced ones of the tooth and the radially inner surfaces of the teeth have circumferentially extending, radially inward opening grooves adapted to capture a severed edge of the seal.

In one embodiment, the holding means comprise interengaging threads while in another embodiment, the holding means include a flange on the container and a flange receiving groove on the cap.

Preferably, the tooth is integrally formed on the cap and both the cap and the tooth are formed of plastic.

In one embodiment, there is an additional tooth which is angularly spaced from the first tooth and located radially closer to the rotation point of the first tooth.

Other objects and advantages will become apparent from the following specification taken in connection with the accompanying drawings.

DESCRIPTION OF THE PREFERRED EMBODIMENTS

Figure 1:
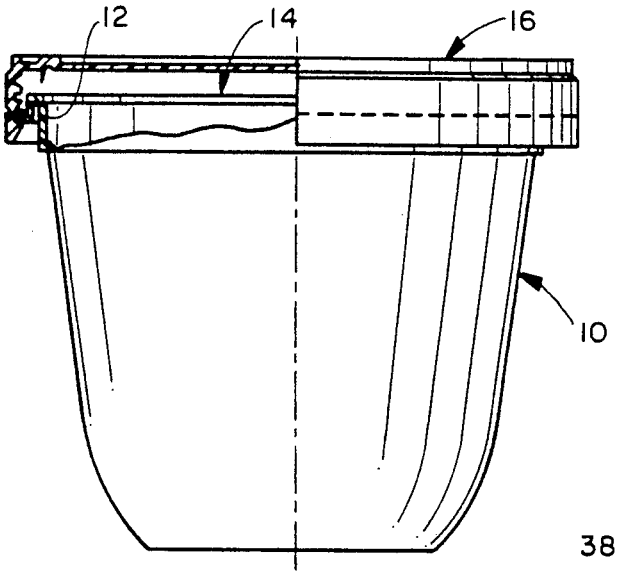
FIG. 1 is a side elevation of a container and cap construction made according to the invention with a part thereof broken away for clarity.

One exemplary embodiment of the invention is illustrated in FIG. 1 and with reference thereto, is seen to include three basic components. The first is a container, generally designated 10. The container includes an access opening 12 which is sealed by a relatively thin membrane-like seal, generally designated 14. As is well-known, the membrane seal 14 may be formed of foil, various plastic films, or composites of various types of film and/or foil. The selection of any particular type of seal 14 is well within the skill of the calling and forms no part of the present invention.

The third component of the container and cap construction made according to the invention is a cap, generally designated 16, which is fitted about the container 10 so as to overlie the seal 14 and occlude the access opening 12.

Figure 2:
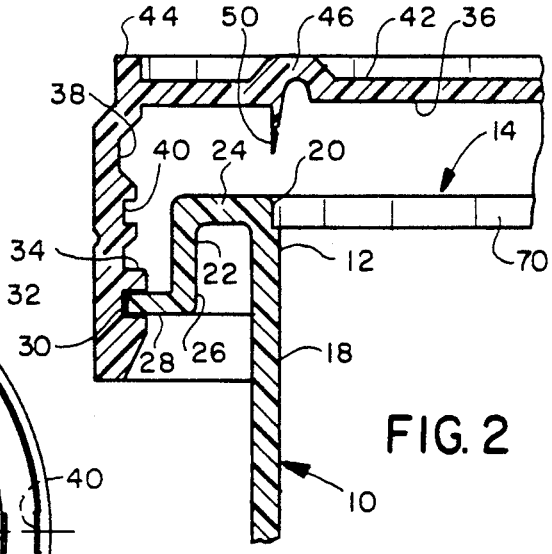
FIG. 2 is an enlarged, fragmentary vertical section showing the point of attachment of the cap to the container.

With reference to FIG. 2, the container 10 includes an inner wall 18. The inner wall 18 terminates at an edge 20 which defines the edge of the access opening 12. It is to be particularly noted that the edge 20 is circular in configuration and has a particular diameter, although the diameter for any given container 10 may be selected simply on the basis of the desired size of the access opening 12.

From the edge 20, the container 10 includes a radially outwardly extending, stepped flange 22. The flange 22 includes a first, radially outwardly extending section 24 in the plane of the edge 20 to which the seal 14 is bonded by any suitable and conventional means. The flange 22 then includes a downwardly directed section 26 which terminates in a radially outwardly directed, peripheral flange 28. In the embodiment illustrated in FIG. 2, the flange 28 is received in a groove 30 formed in a tamper-proof band section 32 of the cap 16. The tamper-proof band section 32 may be conventionally formed and, as is well-known, includes a score line 34 separating the tamper-proof band section 32 from the remainder of the cap 16. By means of a grasping tab (not shown) or the like, the tamper-proof band section 32 ma be broken from the remainder of the cap 16 along the score line 34 to free the remainder of the cap 16.

On the side of the score line 34 remote from the tamper-proof band section 32, the cap 16 includes a bottom surface 36 surrounded by a generally cylindrical peripheral wall 38. Thus, the cap 16 is concave.

At various locations about the peripheral wall 18, on the interior thereof, the same may be provided with grooves 40 (FIGS. 2 and 3) that may removably receive the flange 28 to allow the container 10 to be reclosed by the cap 16 after it has been initially opened.

If desired, the side 42 of the cap 16 opposite the bottom 36 includes partly or wholly peripheral projections 44, 46, which may be utilized as nesting formations. The nesting formations may be employed to center the bottom of a container 10 in a stack of such containers. Alternatively, they may be employed in the manufacture or packaging process to center the caps 16 in a stack before the same are applied to a container 10.

According to the invention, at least one, and preferably at a plurality of locations, cutting teeth 50 are integrally formed on the bottom 36 of the cap 16 so as to project therefrom in a substantially normal direction toward the seal 14. As can be seen in FIG. 2, with the tamper-proof band section 32 in place, the tooth 50 is in spaced relation to the seal 14.

Figure 3:
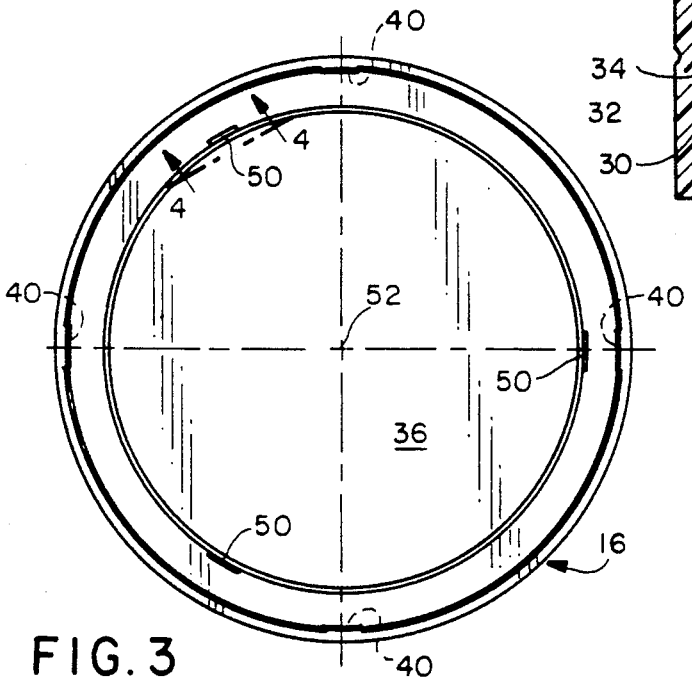
FIG. 3 is a view of the bottom of the cap.
Figure 5:
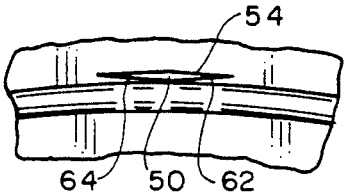
FIG. 5 is an enlarged, fragmentary sectional view taken approximately along the line 5—5 in FIG. 4.
Figure 6:
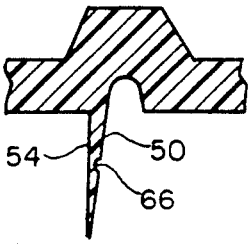
FIG. 6 is a further enlarged, sectional view taken approximately along the line 6—6 in FIG. 4.

Viewing FIG. 3, there are preferably three of the teeth 50 at equally angularly spaced locations about the bottom 36. Each of the teeth 50 in the embodiment shown in FIG. 3 is equally radially spaced from the center 52 of the cap 16. As seen in FIGS. 5 and 6, each of the teeth 50 includes a radially outer surface 54 which is spaced from the point 52 a distance equal to or slightly greater than half the particular diameter selected for the edge 20. That is to say, if two of the teeth 50 were located diametrically oppositely, the distance between the remote surfaces 54 would be equal to or slightly greater than the particular diameter.

Figure 4:
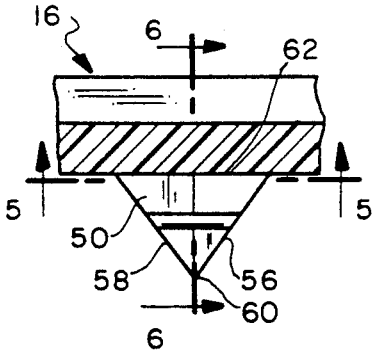
FIG. 4 is an enlarged, sectional view taken approximately along the line 4—4 in FIG. 3.

As seen in FIG. 4, each of the teeth 50 is in the form of an isosceles triangle having two converging sharp edges 56 and 58 which come together in a piercing point 60. It is to be specifically noted, however, that the opposed sharp edges 56 and 58 need not meet in a single point so long as one point is present.

It will also be appreciated that the base 62 of the isosceles triangle shape of each tooth 50 is at least twice the height of the triangle.

In the typical case, the teeth 50 will be formed integrally with the cover 16, usually by being molded out of plastic therewith. Normally, the cap 16 will be constructed of any filled or unfilled polyolefin type of material suitable for contact with the material to be received within the container 10. It is of some significance, however, that the material not be such that the tooth 50 be entirely rigid for purposes to be seen.

As can be seen in FIG. 5, the base or junction between each tooth 50 and the cap 16 is also generally triangular in shape although the radally inner sides 62 and 64 of each tooth are preferably slightly concave, being formed on a radius from remote points as opposed to being planer. This feature of the invention assures that the sharpness of each edge 56, 58 will be maximized.

As seen in FIG. 6, in one embodiment of the invention, each of the teeth 50 is provided with a radially inwardly opening groove 66. The purpose of the grooves 66 will become apparent hereinafter.

Figure 7:
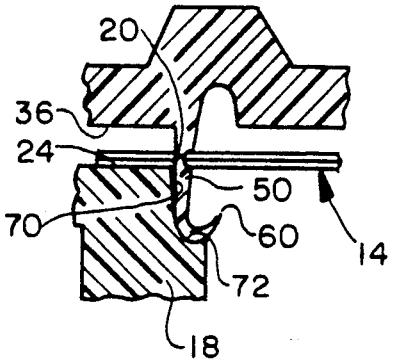
FIG. 7 is an enlarged, fragmentary, sectional view illustrating the relative configuration of components after an opening operation has been initiated.

Returning to FIG. 2 and with additional consideration of FIG. 7, about the access opening 12, and immediately adjacent the edge 22, the wall 18 includes a frusto-conical section 70. The frusto-conical section 70, at a location remote from the edge 20, terminates in a smoothly curved, upwardly opening groove-like surface 72 which extends to the inner wall 18.

Use of this embodiment is as follows. The tamper-proof band section 32 is removed by severing the same along the score line 34 from the remainder of the cap 16 as is wellknown. The cap 16 may then be axially moved toward the container 10 at which time the points 60 on the teeth 50 will pierce the seal 14. At this time, rotation of the cap 16 relative to the container 10 is effected about an axis centered in the access opening 12 and represented by the point 52 (FIG. 3). This will cause one or the other of the edges 58, 60 on each of the teeth 50 to move in abutment with the edge 20. The angle between the two by reason of the shape of the teeth 50 described previously will result in a scissors-like action that will sheer the seal 14 right at the edge 20 in a very positive fashion. With the construction shown wherein three of the teeth 50 are employed at equal angular locations about the cap 16, relative rotation between the container 10 and the cap 16 of approximately 120 degrees will be sufficient to achieve the desired severing.

It should be observed that in the usual case, the cap 16 will be moved sufficiently toward the container 10 such that the bottom 36 of the cap will be in substantial abutment with the seal 14 at the flange section 24 as shown in FIG. 7. The length of the teeth 50 is selected such that when such a relationship is achieved, the same will be cammed radially inwardly by the frusto-conical section 70 and even more so by the groove 72 to the position illustrated in FIG. 7. At this location, it will have been cammed inwardly to a location behind the seal 14 so that upon removal of the cap 16 from the container 10, the severed section of the seal 14 will be captured by the teeth 50.

As another means of capturing the severed section of the seal 14, which may be used either alone or with the camming feature mentioned previously, the grooves 66 on the radially inner side of the teeth 50 may serve to capture an edge of the severed portion of the seal 14 as illustrated in FIG. 7 as well.

Figure 8:
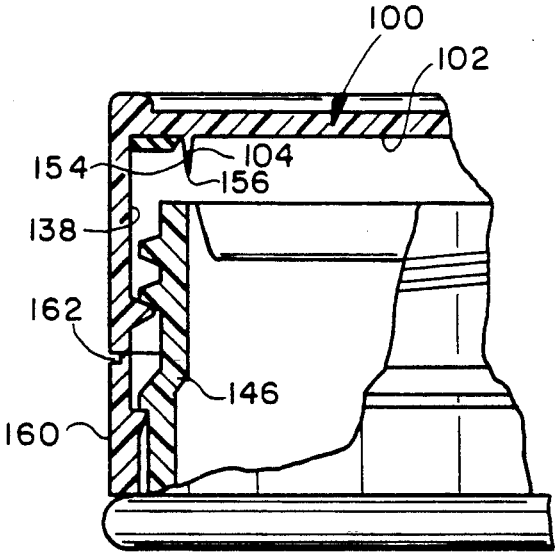
FIG. 8 is a sectional view of a modified embodiment of the invention before the opening sequence has been initiated.
Figure 9:
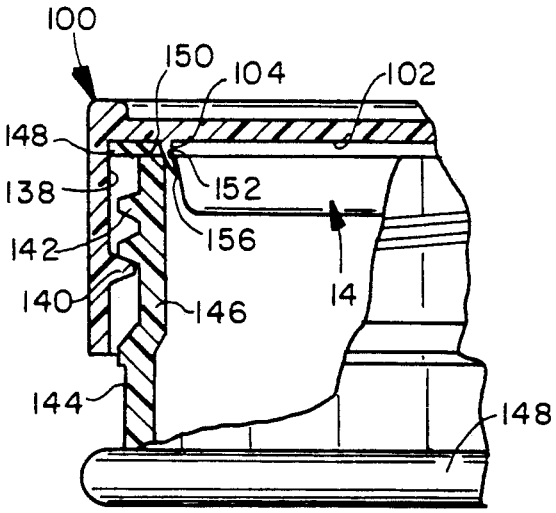
FIG. 9 is a view similar to FIG. 8, but illustrating the components after the opening sequence has been initiated.

An alternative embodiment is illustrated in FIGS. 8 and 9. This embodiment of the invention contemplates a screw-on cap, generally designated 100. This cap 100 includes a bottom 102 from which teeth 104 extend generally normal thereto. The bottom 102 is provided with a generally cylindrical peripheral wall 138 which, on its inner surface, includes threads 140 adapted to cooperate with threads 142 on the exterior surface 144 of the neck 146 of a bottle-like container shown fragmentarily at 148.

At the junction between the inner wall 138 and the bottom 102, a seal 14 may be provided for sealing against an upper surface 150 of the neck 146 when the cap 100 is utilized to reseal the bottle 148.

Adjacent the surface 150, the neck 146 has an edge 152 about the access opening defined by the neck. A seal such as the seal 14 extends across the access opening at this point and is bonded to the surface 150 in a conventional fashion.

In this embodiment of the invention, the radially outer surface 154 of each of the teeth 104 is formed somewhat as a frusto-conical section whose radius decreases as the point 156 of the tooth 104 is approached. The radius at the point 156 in relation to a rotational point for the cap 100 similar to the point 52 (FIG. 3) is equal to one-half the particular diameter at the edge 152 and increases as the bottom 102 is approached. As a consequence, as the relative rotation between the cap 100 and the bottle 148 occurs, and the threads 140, 142 move the cap 100 progressively toward the bottle 148, a camming action between the edge 152 and the radially outer surface 154 of each of the teeth 104 will occur as illustrated in FIG. 9 causing the points 156 to move radially inwardly behind at least part of the severed portion of the seal 14 to capture the same. Again, if desired, the teeth 104 could be provided with structure similar to the groove 66 (FIGS. 4 and 6) for capturing a severed edge of the seal 14.

It will also be observed that the embodiment of FIGS. 8 and 9 is provided with a removable tamper-proof band 160 separated from the remainder of the cap 100 by a score line 162. In this embodiment of the invention, the score line 162 is located on the exterior of the cap 16 rather than interiorally thereof.

Figure 10:
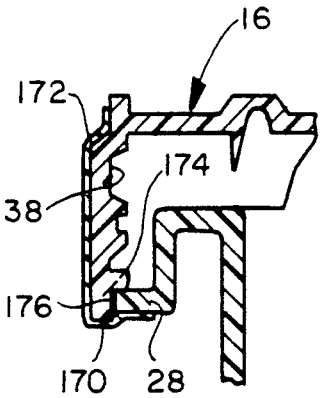
FIG. 10 is a view similar to FIG. 2, but of a modified embodiment of the invention.

FIG. 10 illustrates a modified embodiment of the invention that is generally similar to that illustrated in FIG. 2, but utilizes a shrink-fit film 170 that extends about the exterior surface 172 of cap 16 as well as under part of the flange 28. In this embodiment, the removable tamper-proof band 32 and the associated groove 30 are done away with in favor of an integral ring 174 formed on the interior of the cap 16 and easily severable therefrom by means of a peripheral, downward facing score line 176. According to this embodiment of the invention, all one need do is remove the shrink fit film 170, and then remove the ring 174. After that has occurred, the seal may be severed in the manner mentioned previously.

Figure 11:
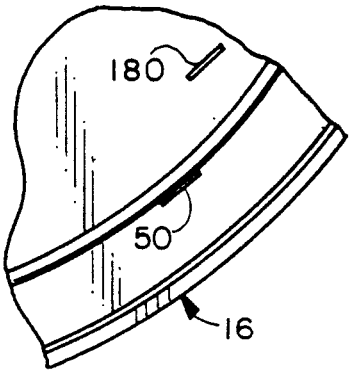
FIG. 11 is a fragmentary view somewhat similar to FIG. 3, but illustrating a modified embodiment of the invention.

In some instances where it is absolutely necessary that the severed part of the seal 14 be secured to the bottle or container, the cover 16 may be provided with an additional tooth 180 as illustrated in FIG. 11. The tooth 180 is located radially inward of the tooth 50 and is angularly spaced therefrom by any desired distance. As a result of this construction, a circularly shaped strand whose width is equal to the radial distance between the teeth 50 and 180 will remain and will connect the inner part of the seal 14 to the flange 24 provided, of course, there has been insufficient rotation between the container 10 and the cap 16 such that the teeth 50 completely sever the seal at their radial location. This embodiment of the invention may be utilized where it is absolutely necessary to prevent a fully detached seal from entering the container.

From the foregoing, it will be appreciated that a container and cap construction made according to the invention provides a means whereby a film or membrane-like foil or plastic seal may be easily severed to achieve access to a container and generally without tearing or otherwise leaving some portion of the seal affixed to the container which would interfere with free access to its contents, affect the pouring characteristics or require multiple repetitive acts to achieve complete removal. At the same time, because the seal is not attached to the cover or cap, removal of the cap still allows inspection of the seal to determine whether the integrity of the container has been violated. Furthermore, the invention provides a variety of means which may be utilized singly or in combination with each other to capture the severed part of the seal to prevent the same from becoming embedded in the contents of the container or otherwise remain in the container to occlude, partially or wholly, the access opening.

I claim:

1. A container and cap comprising a container having an access opening with an edge of circular shape of a particular inside diameter;

a cap for said opening;

means on said cap and said container for removably holding said cap on said container to occlude said access opening;

a membrane or foil-like seal bonded to said container about said access opening and free of said cap; and at least one cutting tooth having radially inner and outer sides and carried by said cap and displaced from a rotation point on said cap about which said cap may be rotated relative to said access opening a distance equal to or slightly more than one-half of said particular diameter and having at least two converging, sharp edges, and at least one piercing point between said sharp edges so that said point may pierce said seal and rotation of said cap relative to said access opening may cause at least one of said sharp edges to cooperate with said access opening edge to provide a scissors-like cutting action on said seal.

2. The container and cap of claim 1 wherein said tooth is shaped as a triangle whose base is at least twice its height.

3. The container and cap of claim 2 wherein said triangle is an isosceles triangle.

4. The container and cap of claim 1 wherein said cap has a concave side for receiving said container about said access opening and said tooth is on said concave side.

5. The container and cap of claim 1 wherein said tooth is bendable and at least one of said tooth and said access opening edge includes means responsive to insertion of said tooth into said access opening for bending said tooth behind said seal.

6. The container and cap of claim 5 wherein the radially outer side of said tooth is displaced from said rotation point a distance just greater than half said particular diameter so that the resulting interference between said access opening edge and said radially outer side will bend said tooth to define said capturing means.

7. The container and cap of claim 5 wherein said capturing means includes a cam surface adjacent said access opening edge engageable by said tooth, said cam surface deflecting said piercing point radially inwardly and behind said seal.

8. The container and cap of claim 5 wherein said capturing means comprises cam means at the interface of said access opening edge and said tooth for camming at least part of said tooth behind said seal.

9. The container and cap of claim 1 wherein there are at least two angularly spaced ones of said tooth, the radially inner sides of said teeth having circumferentially extending, radially inwardly opening grooves adapted capture a severed edge of said seal.

10. The container and cap of claim 1 wherein said holding means comprises interengageing threads.

11. The container and cap of claim 1 wherein said holding means comprises a flange on said container and a flange receiving groove on said cap.

12. The container and cap of claim 1 wherein said tooth is integrally formed on said cap and both said cap and said tooth are formed of plastic.

13. The container and cap of claim 1 further including an additional tooth angularly spaced from said first-named tooth and located radially closer to said rotation point than said first-named tooth.

14. A container and cap comprising:

a container having an internal cavity for receipt of the material to be contained, a circular access opening and an external, cap retaining formation;

a membrane and/or foil-like seal sealing said opening and bonded to said container;

a cap for said opening and having a concave side disposable on said container about said access opening and provided with a mating, internal cap retaining formation for cooperation with said external cap retaining formation to removably retain said cap on said container, said concave side being defined by a bottom and a generally cylindrical peripheral wall surrounding said bottom;

at least one tooth on said bottom extending therefrom and generally normal thereto said tooth being radially displaced from the center of said bottom; and means normally spacing said bottom and said tooth away from and out of contact with said seal, said normally spacing means being operable to allow said bottom and said tooth to move toward said seal so that said tooth may pierce said seal;

whereby relative rotation between said cap and said container will cut said seal to allow access to said cavity seal; and means on at least one of said cap and said tooth for capturing said seal within said concave side when said seal has been cut free from said container by said tooth;

whereby relative rotation between said cap and said container will cut said seal to allow access to said cavity.

15. A package comprising:

a container having an access opening with an edge of circular shape and of a particular inside diameter;

a membrane or foil-like seal bonded to said container about said access opening;

a separate element removably carried by said container and adapted to be placed over said opening and rotated relative thereto; and at least one cutting tooth carried by said element and displaced from a rotation point on said element about which said element may be rotated relative to said access opening a distance equal to or slightly more than one-half of said particular diameter and having at least two converging, sharp edges, and at least one piercing point between said sharp edges so that said point may pierce said seal and rotation of said element relative to said access opening may cause at least one of said sharp edges to cooperate with said access opening edge to provide a scissors-like cutting action on said seal.

16. The package of claim 15 wherein said tooth is shaped as a triangle whose base is at least twice its height.

17. The package of claim 16 wherein said triangle is an isosceles triangle.

18. The package of claim 15 wherein said element is a cap for said opening.

19. The package of claim 18 wherein said cap has a concave side for receiving said container about said access opening and said tooth is on said concave side.

* * * * *